United States Patent [19]

Johansing, Jr.

[11] 4,245,785

[45] Jan. 20, 1981

[54] SYSTEM FOR SPRAYING LIQUID EMULSION AND SOLVENT THEREFOR

[76] Inventor: Paul G. Johansing, Jr., 14069 Bayside Dr., Norwalk, Calif. 90650

[21] Appl. No.: 13,973

[22] Filed: Feb. 22, 1979

[51] Int. Cl.[3] ..... B05B 15/02

[52] U.S. Cl. ..... 239/112; 239/119; 239/305; 239/530

[58] Field of Search ..... 239/112, 119, 305, 526, 239/530, 120

[56] References Cited

U.S. PATENT DOCUMENTS

| | | | |
|---|---|---|---|
| 3,674,205 | 7/1972 | Kock | 239/112 X |
| 3,690,557 | 9/1972 | Higgins | 239/112 |
| 3,870,233 | 3/1975 | Wilhelm | 239/112 X |

*Primary Examiner*—Richard A. Schacher
*Attorney, Agent, or Firm*—Fraser and Bogucki

[57] ABSTRACT

In a system for spraying liquid asphalt emulsion and solvent therefor, a hydraulic system including a pair of hydraulic motors is used to selectively drive a pair of pumps coupled to provide either liquid asphalt emulsion or solvent therefor to a flapper type check valve. The flapper type check valve readily passes liquid asphalt emulsion therethrough to a spray wand with backflow of the liquid asphalt emulsion to the pump for the solvent being blocked by a solvent check valve. When spraying of the liquid asphalt emulsion is completed, the solvent pump is turned on to force solvent at a relatively high pressure into the flapper type check valve to cleanse the hinged flapper mechanism within the check valve and then the components down-stream thereof including the spray wand. Accumulations of solidified asphalt emulsion which may prevent the hinged flapper mechanism from closing are eventually dissolved by the solvent which in the meantime flows through the open hinged flapper mechanism and toward the liquid asphalt emulsion pump. The liquid asphalt emulsion pump is protected by a liquid asphalt emulsion check valve which opens in response to the high pressure solvent so as to divert the solvent to a catch tank.

10 Claims, 3 Drawing Figures

FIG.2
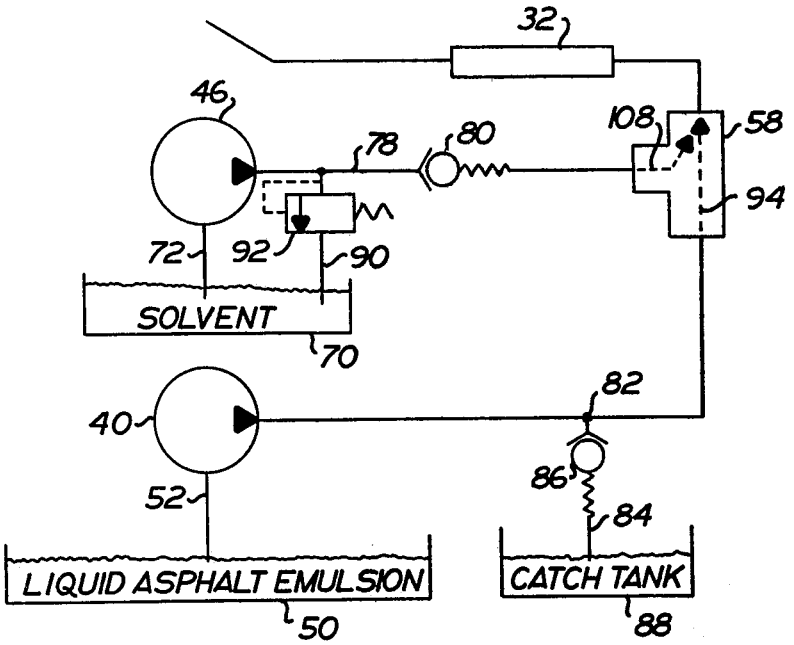
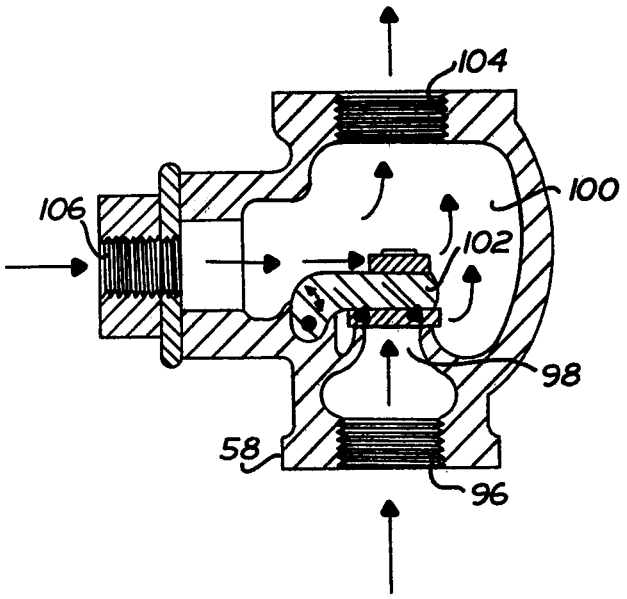
FIG.3

SYSTEM FOR SPRAYING LIQUID EMULSION AND SOLVENT THEREFOR

BACKGROUND OF THE INVENTION

1. Field of the Invention

The present invention relates to systems for spraying a liquid emulsion and a solvent for the emulsion, and more particularly to systems which spray liquid asphalt emulsion onto roadway surfaces for roadway distress and pothole repairs and which are cleansed by a solvent for the emulsion.

2. History of the Prior Art

According to the Asphalt Institute, pavement repair requires certain procedures and specific materials for each case of roadway distress or damage. A pothole is an example of localized roadway distress which requires "Full depth asphalt patching." The method for repairing this type of condition requires the following equipment and procedures to be used:

a. Using a pavement hammer or saw, an area is excavated and sides are cut in rectangular with vertical faces.
b. Subgrade is dried and compacted.
c. A tack coat of liquid asphalt emulsion (LAE) is applied by a sprayer to the sides of the rectangular cut.
d. The hole is backfilled with hot plant mixed asphalt cement.
e. The new material is rolled flat to complete the repair. A vibratory compactor is used on small repairs.

A common method for roadway maintenance crews to transport the equipment needed for the above procedures is to use a dump truck loaded with hot asphalt cement and pulling a sprayer for LAE and a smaller truck pulling an air compressor to run an air hammer. If the area to be patched is large, a third truck is needed to pull a roller. Some pavement maintenance crews are equipped with a special dump truck with either an air compressor or hydraulic units to operate the air or hydraulic pavement hammer and LAE sprayer mounted onto the truck body. The truck is also equipped with a trailer hitch to pull a roller when necessary. The latter method is especially suited to repairing small damaged areas such as potholes, where small amounts of materials are used in a variety of localities.

National attention has been given to the repair of minor roadway damage. Potholes have become so numerous that large areas of roadways are further endangered because the water protection to the subgrade is eliminated, not to mention the hazards to safety and damage to car and truck steering systems which result if the pothole is not repaired.

Considering the procedures required to repair pothole areas and often the bad weather conditions which affect not only the heated materials but the personnel required to work, improvement in productivity will come only with an improvement in the equipment and work methods used. For this reason, the use of hydraulic hammers and hydraulic LAE sprayers has become more popular. The rising cost of air compressors compared to the cost of a hydraulic pump and the recent technical developments in hydraulic hammers have prompted this change. It appears that maximum production of pothole repairs will occur with the use of a single truck system and a small three man crew. Because hydraulic power uses less space and costs less than air systems sized large enough to run an air hammer, there will most likely be an increase in the use of this type of system. Much work has been done to increase the acceptability of the hydraulic hammer which is required if the air hammer and compressor is not provided. However, a need for the improvement of the LAE sprayer exists in any event.

Observation has shown that when potholes are repaired in bad weather, the use of LAE is often eliminated from the procedure, contrary to proper practice. This is largely due to the fact that LAE is required to be at a warm temperature (100°–140° F.) and also has a very unstable nature when heated frequently, as is the case when the material is stored in large quantities, and used in small quantities. LAE consists of a paving grade asphalt which has been heated to 250°–325° F. and mixed with water blending with surfactants, stabilizers and emulsifiers. If the water content of the resulting emulsion is reduced by evaporation caused by reheating, the emulsion develops "shot" or congealed solids of asphalt which are usually dispersed in the emulsion. For this reason, LAE is considered unstable and care to prevent deemulsification must be taken. Frequent heating can easily evaporate the water solvent and the small pressure needed to spray the material (about 50 psi) can also increase the tendency to promote solids in the sprayer distributor, especially if the water solvent quantity has been reduced. Minimum temperature for LAE is 70° F. for sprayer application, while 100° F. is optimum. Some LAE materials require a higher sprayer liquid temperature.

Experience has shown that the best way to keep an LAE sprayer operating and dependable is to flush the system with solvent after each use of the sprayer. The solvent employed is usually No. 2 fuel oil or diesel fuel. When plugging of solids occurs, further pumping of LAE to remove the plugs can result in even more plugging by causing the compaction of the LAE. Even when precautions such as insulating the LAE reservoir to prevent frequent reheating and the use of a filter upstream of the LAE pump with frequent cleaning are taken, LAE solids are encountered in the spraying of LAE during times of high production unless frequent flushing of LAE is accomplished.

In one conventional LAE sprayer, by way of example, separate sources of LAE and solvent are coupled to a common pump which pumps one or the other through a spray wand. Two different ball valves must be closed each time it is desired to switch from spraying LAE to solvent to cleanse the sprayer. Consequently use of solvent is infrequent, and buildup of clogging LAE solids is common. At that, the common pump which is designed to optimize pumping of LAE is ill-suited for use with solvent. The pump is incapable of withstanding the higher pressure needed for the solvent to be effective, and attempts to raise the solvent pressures usually result in the pump seal being broken.

Accordingly, it would be desirable to provide an LAE sprayer which is easily switched from spraying LAE to solvent for cleansing or other application of the solvent. The solvent should ideally be available at high pressure without damage to pumps and other equipment in the system and without danger of backflowing or other intermixing with LAE.

BRIEF DESCRIPTION OF THE INVENTION

Spraying systems in accordance with the invention use two separate pumps to force LAE and LAE solvent into a common conduit and thereby to a spray apparatus. The resulting arrangement of pumps, piping and valves can be operated conveniently at the spray position to select either LAE or LAE solvent. A specially designed check valve protects the low pressure density LAE pump from a higher solvent pressure when being used to flush LAE and solids of LAE through and out the sprayer system.

Heated LAE stored in an insulated reservoir is pumped by use of a common helical rotor pump through a conduit to an emulsion check valve coupled to a catch tank. The low pressure emulsion check valve prevents overpressure of the LAE pump and its low pressure seal. A conduit carries the pumped LAE past the emulsion check valve to a specially designed flapper type check valve.

The flapper type check valve has a hinged door covering the inlet for LAE to the valve body. An additional port is provided in the valve body to allow the entry of solvent which scours the hinge apparatus of the flapper valve to remove any LAE including solids thereof which may be deposited there before continuing to flush the valve annd then travelling downstream to the spray wand. By cleaning the valve mechanism, the valve flapper is made to close tightly against the port opening for LAE entry into the valve. The higher pressure capacity of a solvent pump, which is a common gear type pump with a relatively high pressure relief setting, provides sufficient force to purge solid LAE which may be lodged in the spray apparatus or conduit downstream of the LAE pump.

The emulsion check valve allows the leakage of solvent through the flapper type check valve to the catch tank without damage to the LAE pump, in the event an accumulation of solids in the region of the hinged flapper door prevents the door from closing. When the solids are cleared, the door closes and the solvent cleanses the rest of the flapper type check valve and then the spray wand. The catch tank can accumulate both solvent and LAE. Upon draining the tank, filtered solvent can be reclaimed for later use.

A solvent check valve coupled between the solvent pump and the flapper type check valve prevents LAE from backflowing from the flapper type check valve to the solvent pump. This valve opens at a relatively low pressure less than atmospheric pressure.

BRIEF DESCRIPTION OF THE DRAWINGS

The foregoing and other objects, features and advantages of the invention will be apparent from the following more particular description of a preferred embodiment of the invention, as illustrated in the accompanying drawings, in which:

FIG. 2 is a schematic diagram of a portion of the system of FIG. 1; and

FIG. 3 is a cross-sectional view of a flapper type check valve used in the system of FIG. 1.

DETAILED DESCRIPTION

Figure 1:
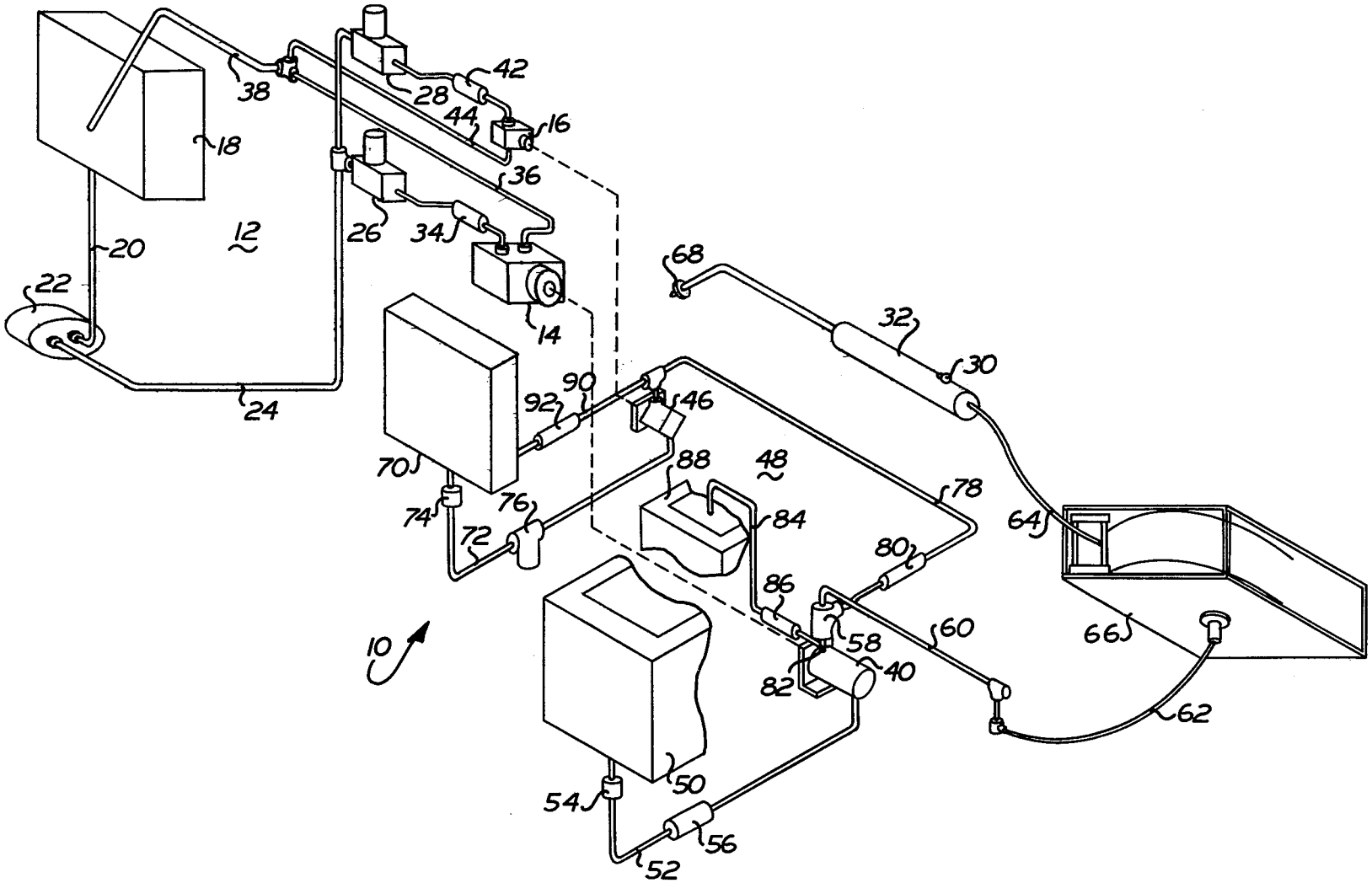
FIG. 1 is a perspective view of a system for spraying liquid emulsion and solvent therefor in accordance with the invention.

FIG. 1 depicts a preferred arrangement of a system 10 for spraying liquid emulsion and solvent therefor in accordance with the invention. The system 10 includes a hydraulic system 12 for driving a liquid asphalt emulsion (LAE) motor 14 and a solvent motor 16. The hydraulic system 12 includes a reservoir 18 for storing a quantity of hydraulic fluid and which may include a heat exchanger and a cooled refrigerant in the manner described in a co-pending application of P. G. Johansing, Jr., filed Aug. 15, 1977, Ser. No. 824,418.

Hydraulic fluid stored in the reservoir 18 flows via a conduit 20 to a variable volume hydraulic pump 22 from which the fluid is pumped via a conduit 24 through a pair of solenoid controlled hydraulic valves 26 and 28. The hydraulic valves 26 and 28 are controlled by a switch 30 mounted on a wand 32 for spraying LAE. When the hydraulic valve 26 is opened by action of the switch 30, hydraulic fluid from the conduit 24 flows via a flow control 34 to the LAE motor 14, then back to the reservoir 18 via a conduit 36 and a common conduit 38. The hydraulic fluid applied to the LAE motor 14 causes the motor 14 to rotatably drive an LAE pump 40 which is mechanically coupled thereto. When the switch 30 on the wand 32 is positioned so as to close the solenoid controlled hydraulic valve 26, the valve 26 blocks the flow of hydraulic fluid to the LAE motor 14 so as to prevent driving of the LAE pump 40.

When the solenoid controlled hydraulic valve 28 is opened by action of the switch 30, hydraulic fluid from the conduit 24 flows through a flow control 42 to the solvent motor 16, then via a conduit 44 and the common conduit 38 to the reservoir 18. This causes the solvent motor 16 to rotatably drive a solvent pump 46 to which the motor 16 is mechanically coupled.

The switch 30 on the wand 32 has three different positions. In a first or neutral position, the hydraulic valves 26 and 28 both remain closed and neither of the motors 14 and 16 operates. When the switch 30 is moved into a second position to spray LAE out of the wand 32, the hydraulic valve 26 is opened so as to operate the LAE motor 14 and thereby drive the LAE pump 40. When the switch 30 is moved into a third position in which solvent is to be forced into certain parts of the spraying system 10 to cleanse the system, the hydraulic valve 28 is opened so as to operate the solvent motor 16 and the solvent pump 46 which is coupled thereto.

In addition to the hydraulic system 12, the spraying system 10 is comprised of an LAE-solvent system 48 which includes the LAE pump 40, the solvent pump 46 and the wand 32 with its included switch 30. The LAE-solvent system 48 includes an LAE tank 50 for storing a quantity of liquid asphalt emulsion. The tank 50 preferably includes a heater system for maintaining the LAE at a desired temperature in which the LAE remains fluid and does not solidify. LAE within the tank 50 flows via a conduit 52 which includes a shut-off valve 54 and an emulsion filter 56 to the LAE pump 40.

When it is desired to spray LAE from the wand 32, the switch 30 is moved into the second position to open the solenoid controlled hydraulic valve 26 and operate the LAE motor 14. This rotates the LAE pump 40 which in the present example is of the helical rotor type so as to pump LAE through a flapper type check valve 58 to a conduit 60. LAE in the conduit 60 flows via a flexible conduit 62 into a hose 64 contained within a hose reel 66. The hose reel 66 permits the person using the wand 32 to pull out as much of the hose 64 as is needed to reach the job site from the truck or other vehicle on which the spraying system 10 is typically mounted. LAE within the hose 64 is pumped through the wand 32 and out of a tip 68 thereof.

The LAE-solvent system 48 further includes a solvent tank 70 for containing a quantity of solvent. The solvent within the tank 70 flows in a conduit 72 which includes a shut-off valve 74 and a solvent filter 76 to the solvent pump 46. When the switch 30 is moved to the third position so as to turn on the solvent motor 16 and thereby drive the solvent pump 46, the pump 46 pumps solvent from the conduit 72 via a conduit 78 and an included solvent check valve 80 to the flapper type check valve 58. As described hereafter in connection with FIG. 3 the solvent entering the valve 58 cleanses the flapper door within the valve 58 including the hinged portion thereof before continuing through the conduit 60, the conduit 62, the hose 64 and the wand 32 so as to cleanse those parts of LAE in addition to the valve 58.

The LAE pump 40 is coupled to the flapper type check valve 58 by a small section of conduit in the form of a tee 82 which also couples to a conduit 84. The conduit 84 which includes an emulsion check valve 86 communicates with a catch tank 88. The output side of the solvent pump 46 is also coupled to the solvent tank 70 by a conduit 90 which includes a relief valve 92.

It will be appreciated by those skilled in the art that the flapper type check valve 58, the solvent check valve 80 and the emulsion check valve 86 combine to enable quick switching between spraying of LAE and spraying of solvent without danger to various components within the system and without backflow into or interference with other portions of the system. When the LAE pump 40 is turned on to spray LAE, the LAE at the tee 82 bypasses the emulsion check valve 86 and proceeds to the flapper type check valve 58. As shown by a dashed line 94 in FIG. 2 the LAE moves upwardly through the valve 58 to the wand 32. The emulsion check valve 86 is set to open at a pressure such as 150 psi which is greater than the pressure of the LAE but considerably less than the pressure under which the solvent is pumped by the solvent pump 46. For this reason the LAE from the pump 40 bypasses the emulsion check valve 86 and proceeds to the flapper type check valve 58. Should any LAE within the flapper type check valve 58 attempt to backflow through the conduit 78 to the solvent pump 46, such backflow is prevented by the solvent check valve 80. The solvent check valve 80 is set to open at a pressure such as 5 psi which is less than atmospheric pressure. Thus, while solvent can readily flow from the pump 46 to the check valve 58 unimpeded by the solvent check valve 80, the solvent check valve 80 closes so as to prevent backflow of any LAE into the solvent system.

The internal details of the flapper type check valve 58 are shown in FIG. 3. LAE from the pump 40 enters at an inlet 96 from which it proceeds upwardly through an annular opening 98 to the interior 100 of the valve 58. The annular opening 98 is normally closed by a hinged flapper mechanism 102. The flapper mechanism 102 which is normally in the closed position shown in FIG. 3 as a result of gravity, responds to pressure differences on the opposite sides thereof to selectively open and close. When LAE is forced into the inlet 96 and into the annular opening 98 under pressure, the hinged flapper mechanism 102 opens so as to allow the LAE to flow through the interior 100 and through an outlet 104 at the top of the valve 58 to the conduit 60 shown in FIG. 1. When pumping of the LAE is terminated, the forces of gravity normally return the hinged flapper mechanism 102 to the closed position as shown in FIG. 3. If the mechanism 102 is not immediately returned to the closed position by gravity, operation of the solvent pump 46 so as to feed solvent under high pressure into a port 106 at the side of the valve 58 is normally sufficient to force the hinged flapper mechanism 102 back into a closed position on the annular opening 98.

As the solvent enters the port 106 under high pressure which may approach 700 psi, the solvent cleanses the hinged flapper mechanism 102 on its way to cleansing the components downstream therefrom including the conduit 60, the flexible conduit 62, the hose 64 and the wand 32. In the event LAE solids or other buildup in the region of the hinged flapper mechanism 102 prevents the mechanism 102 from closing, the solvent leaks through the annular opening 98 and the inlet 96 to the tee 82. The emulsion check valve 86 which in the present example opens at 65 psi, responds to the solvent having a pressure of upward of 700 psi by opening so as to allow the solvent to flow via the conduit 84 into the catch tank 88. This prevents the high pressure solvent from backing into the LAE pump 40 so as to blow the seal and otherwise damage or possibly destroy the pump 40. In this way the solvent flows through the emulsion check valve 86 and into the catch tank 88 long enough to clear solid particles and buildup from the hinged flapper mechanism 102 without damaging the LAE pump 40 or otherwise interferring with the LAE system. As soon as the hinged flapper mechanism 102 is able to close, the solvent is forced up through the outlet 104 of the flapper type check valve 58 so as to cleanse the parts downstream therefrom. This normal direction of solvent movement from the port 106 to the outlet 104 is shown by a dashed line 108 in FIG. 2.

As previously noted the output of the solvent pump 46 in addition to being coupled to the solvent check valve 80 returns to the solvent tank 70 via the conduit 90 and its included relief valve 92. In the event the solvent pressure in the output of the pump 46 becomes excessive, such as by exceeding 700 psi in the present example, the relief valve 92 opens to return solvent to the tank 70 as necessary to reduce the solvent pressure to a safe level.

As previously noted the solvent check valve 80 has an opening pressure on the order of 5 psi in the present example. It has been found in practice that the solvent cannot pass into the flapper type check valve 58 unless the opening pressure of the valve 80 is less than atmospheric pressure. This is due to the fact that the suction of the solvent pump 46 is less than the pressure required to override the spring of the valve 80. Setting the valve spring at less than atmospheric pressure insures that if the solvent empties and the solvent pump 46 loses its "prime," the filling of new solvent into the solvent tank 70 can be pumped through to the flapper type check valve 58. In the present example the solvent check valve 80 can comprise a Vickers Model No. DT8P1-03-5 check valve.

As previously noted the emulsion check valve 86 preferably has an opening pressure greater than the pumping pressure of the LAE but less than the typical solvent pressure. One example of a check valve which can be used is sold by Vickers as their Model No. DT8P1-06-65.

An example of a valve which can be used as the flapper type check valve 58 is a swing check valve sold under the designation IB952 By Hammond Valve Corporation. Such valve must be modified to provide the port 106 in the side thereof. Such port can comprise a threaded opening for coupling to the conduit 78.

While the invention has been particularly shown and described with reference to a preferred embodiment thereof, it will be understood by those skilled in the art that various changes in form and details may be made therein without departing from the spirit and scope of the invention.

What is claimed is:

1. A system for spraying liquid asphalt emulsion and a solvent comprising the combination of a source of liquid asphalt emulsion, means for dispensing a spray, check valve means coupling the source of liquid asphalt emulsion to the means for dispensing and operative in response to the presence of a pressure differential thereat to pass liquid asphalt emulsion from the source of liquid asphalt emulsion to the means for dispensing, a source of solvent coupled to the check valve means, means coupled between the source of solvent and the check valve means for preventing flow of liquid asphalt emulsion from the check valve means to the source of solvent, the check valve means further being operative in response to the presence of a pressure differential thereat to pass solvent from the source of solvent to the means for dispensing while normally blocking the flow of solvent to the source of liquid asphalt emulsion, and means coupled between the source of liquid asphalt emulsion and the check valve means for preventing flow of solvent from the check valve means to the source of liquid asphalt emulsion.

2. The invention set forth in claim 1, wherein the check valve means includes a hollow housing having an inlet coupled to the source of liquid asphalt emulsion, an outlet coupled to the means for dispensing, a side port coupled to the source of solvent and a hinged flapper mechanism mounted within the hollow housing adjacent the side port and being movable in response to a pressure differential thereon between a closed position in which the inlet is blocked from the hollow interior of the housing and an open position in which the inlet communicates with the outlet via the hollow interior of the housing.

3. A system for spraying liquid asphalt emulsion and a solvent comprising the combination of a source of liquid asphalt emulsion, means for dispensing a spray, check valve means coupling the source of liquid asphalt emulsion to the means for dispensing and operative to pass liquid asphalt emulsion from the source of liquid asphalt emulsion to the means for dispensing, a source of solvent coupled to the check valve means, means coupled between the source of solvent and the check valve means for preventing flow of liquid asphalt emulsion from the check valve means to the source of solvent, the check valve means further being operative to pass solvent from the source of solvent to the means for dispensing while normally blocking the flow of solvent to the source of liquid asphalt emulsion, and means coupled between the source of liquid asphalt emulsion and the check valve means for preventing flow of solvent from the check valve means to the source of liquid asphalt emulsion, the means for preventing flow of liquid asphalt emulsion from the check valve means to the source of solvent comprising a valve operative to open at a pressure less than atmospheric pressure.

4. A system for spraying liquid asphalt emulsion and a solvent comprising the combination of a source of liquid asphalt emulsion, means for dispensing a spray, check valve means coupling the source of liquid asphalt emulsion to the means for dispensing and operative to pass liquid asphalt emulsion from the source of liquid asphalt emulsion to the means for dispensing, a source of solvent coupled to the check valve means, means coupled between the source of solvent and the check valve means for preventing flow of liquid asphalt emulsion from the check valve means to the source of solvent, the check valve means further being operative to pass solvent from the source of solvent to the means for dispensing while normally blocking the flow of solvent to the source of liquid asphalt emulsion, and means coupled between the source of liquid asphalt emulsion and the check valve means for preventing flow of solvent from the check valve means to the source of liquid asphalt emulsion, the means for preventing flow of solvent from the check valve means to the source of liquid asphalt emulsion comprising a valve operative to open at a pressure greater than liquid asphalt emulsion pressure and less than solvent pressure.

5. A system for spraying a liquified substance and a solvent for the substance comprising the combination of a first container for storing the liquified substance, a second container for storing the solvent, a first pump coupled to pump the liquified substance from the first container, a second pump coupled to pump the solvent from the second container, a wand assembly for spraying liquids provided thereto, a valve having an input coupled to the first pump, an outlet coupled to the wand assembly and a port coupled to the second pump and movable means responsive to a pressure differential thereacross to allow liquified substance applied under pressure at the inlet to freely pass to the outlet and to normally close off the inlet to the outlet while allowing communication from the port to the outlet in response to solvent applied under pressure at the port.

6. The invention set forth in claim 5, wherein the movable means comprises a hinged flapper door movable between an open position and a closed position in which the door covers an opening between the inlet and the outlet.

7. The invention set forth in claim 5, further including a conduit coupled between the first pump and the inlet of the valve, a third container, a second valve in the form of a check valve coupled between the conduit and the third container, and a third valve in the form of a check valve coupled between the port of the first-mentioned valve and the second pump.

8. A system for spraying a liquified substance and a solvent for the substance comprising the combination of first and second hydraulic motors, means for selectively operating either of the first and second hydraulic motors, first and second pumps coupled to be driven by the first and second motors respectively when the motors are operated, first and second containers for respectively storing liquified substance and solvent therein, a spray wand, a first check valve, first conduit means coupling the first check valve to the spray wand, second conduit means coupled between the first check valve and the first container and including the first pump, a third container, a second check valve, third conduit means coupled between the third container and the second conduit means between the first check valve and the first pump and including the second check valve, a third check valve, and fourth conduit means coupled between the first check valve and the second pump and including the third check valve.

9. The invention set forth in claim 8, further including a pressure relief valve and fifth conduit means coupled between the second container and the fourth conduit means between the third check valve and the second pump and including the pressure relief valve.

10. The invention set forth in claim 8, wherein the means for selectively operating either of the first and second hydraulic motors includes a fourth container for storing hydraulic fluid, a hydraulic fluid pump coupled to the fourth container, first and second solenoid controlled valves coupled between the hydraulic fluid pump and the first and second hydraulic motors respectively, means for providing hydraulic fluid return paths from the first and second hydraulic motors to the fourth container, and electric switch means coupled to selectively energize either of the solenoid controlled valves.

* * * * *